US007308771B2

(12) United States Patent
Memelink

(10) Patent No.: US 7,308,771 B2
(45) Date of Patent: Dec. 18, 2007

(54) CARD HOLDER

(76) Inventor: Harry Memelink, 417 Cuba Street, Petone, Lower Hutt (NZ)

( * ) Notice: Subject to any disclaimer, the term of this patent is extended or adjusted under 35 U.S.C. 154(b) by 0 days.

(21) Appl. No.: 10/386,689

(22) Filed: Mar. 13, 2003

(65) Prior Publication Data

US 2004/0177542 A1 Sep. 16, 2004

(51) Int. Cl.
*G09F 3/18* (2006.01)

(52) U.S. Cl. ..... 40/649; 40/661.04; 40/586; 40/606.18; 150/147; 206/37

(58) Field of Classification Search ..... 40/642.02, 40/649, 653, 657, 661.04, 654.01, 586, 606.18; 283/75; 150/147; 206/37, 39, 449, 555
See application file for complete search history.

(56) References Cited

U.S. PATENT DOCUMENTS 1,670,343 A * 5/1928 Clemens ..... 206/39.5
2,145,296 A * 1/1939 Draper et al. ..... 40/1.5
2,162,025 A * 6/1939 McClaughry ..... 40/765
3,029,537 A * 4/1962 Hopp et al. ..... 40/653
3,958,690 A * 5/1976 Gee, Sr. ..... 206/232
4,450,955 A * 5/1984 Featherston ..... 206/39.6
4,518,080 A * 5/1985 Ohlson ..... 206/39
4,805,331 A * 2/1989 Boggess et al. ..... 40/651
4,909,464 A * 3/1990 Levine et al. ..... 248/220.22
5,217,056 A * 6/1993 Ritter ..... 150/147
5,388,739 A * 2/1995 Gargan ..... 224/604
5,718,329 A * 2/1998 Ippolito et al. ..... 206/38
5,901,764 A * 5/1999 Ritter ..... 150/147
6,050,014 A * 4/2000 Ohlson ..... 40/649
6,089,289 A * 7/2000 Florjancic ..... 150/147
6,155,410 A * 12/2000 Davis ..... 206/39.5
6,427,837 B1 * 8/2002 Shields ..... 206/449
6,581,762 B2 * 6/2003 Keough ..... 206/39.4
2002/0117243 A1 * 8/2002 Koren ..... 150/147
2002/0129527 A1 * 9/2002 Vaudreuil ..... 40/655
2003/0101630 A1 * 6/2003 Garcia et al. ..... 40/658

FOREIGN PATENT DOCUMENTS

EP 337452 A2 * 10/1989

OTHER PUBLICATIONS

English translation of EP 337452 A2.*

* cited by examiner

*Primary Examiner*—Gary C. Hoge
(74) *Attorney, Agent, or Firm*—Bio Intellectual Property Services (Bio IPS) LLC.; O. M. (Sam) Zaghmout

(57) ABSTRACT

A card holder 1, has a body 2 which has a first face 3 and a second face, and ledge means 5, the first and second faces being at substantially opposite sides of the card holder 1, and the ledge means 5 extending around at least part of the first and second faces, the card holder 1 being formed such that when it is in use a pair of substantially planar cards can be held by the card holder 1 wherein one of the cards is adjacent the first face 3 and the other of the cards is adjacent the second face and wherein inadvertent release of the cards from the card holder is substantially prevented by way of the ledge means 5.

14 Claims, 3 Drawing Sheets

CARD HOLDER

FIELD OF INVENTION

This invention relates to a holder for cards. A particularly preferred form of the invention relates to a holder for identity and security cards used to activate doors within buildings.

BACKGROUND

It is known to use plastic cards having a magnetic code to activate door locks in buildings. For example, many businesses issue employees with security swipe cards, each card having a magnetic strip or some alternative, to enable employees to open locked doors and enter areas from which it is desired to exclude non-authorised personnel. Employees may also be issued with identity cards, or alternatively a single card to achieve both security and identity functions. It is also known to provide such employees with a holder for such cards which can be attached to clothing of the employees by way of a retractable line or the like. A disadvantage with many known holders is that they are only able to receive and hold one card. It is accordingly an object of at least one form of the present invention to go at least some way towards addressing this disadvantage, or to at least provide the public with a useful choice.

SUMMARY OF THE INVENTION

According to one aspect of the invention there is provided a card holder, having a body which has a first face and a second face, and ledge means, the first and second faces being at substantially opposite sides of the card holder, and the ledge means extending around at least part of the first and second faces, the card holder being formed such that when it is in use a pair of substantially planar cards can be held by the card holder wherein one of the cards is adjacent the first face and the other of the cards is adjacent the the second face and wherein inadvertent release of the cards from the card holder is substantially prevented by way of the ledge means.

Preferably the ledge means comprises flange means arranged to extend across part of the cards when they are held by the card holder as set out above.

Preferably the card holder has a pair of attachment apertures arranged such that they are suitable for receiving an attachment line to attach the card holder to clothing of an individual when the card holder is in use, one of the attachment apertures being at a first edge part of the card holder and the other attachment aperture being at a second edge part of the card holder, the edge parts being substantially perpendicular to one another.

Preferably the card holder has projection means on the first and/or second face, the projection means arranged to facilitate a close fit of at least one of the cards to the card holder when the card holder is in use.

Preferably the projection means is positioned such it does not contact a magnetic strip or similar of one of the cards when that card is in a normal in-use situation with the card holder.

Preferably the projection means is a ridge or ridges.

Preferably the projection means is a series of nodes.

Preferably the card holder is substantially rectangular, and the ledge extends around at least part of each of each of the four edges of the rectangular shape.

According to a further aspect of the invention there is provided a card holder, having a body which has a first face and a second face, and ledge means, the first and second faces being at substantially opposite sides of the card holder;

the ledge means extending around at least part of the first and second faces, and having flange means extending across part of the first and second faces;

a first attachment aperture and a second attachment aperture, each attachment aperture being at a different edge part of the card holder and wherein each of these edge parts is substantially perpendicular with respect to one another;

the first and second faces each having projection means extending outwardly from the first and second faces respectively, the card holder being formed such that when it is in use a pair of substantially planar cards can be held by the card holder wherein one of the cards is adjacent the first face and the other of the cards is adjacent the the second face such that each card is located between the flange means and the projection means respectively at a different side of the card holder, and wherein inadvertent release of the cards from the card holder is substantially prevented by way of the ledge means.

According to a further aspect of the invention there is provided a card holder, having a body which has a first face and a second face, and ledge means, the first and second faces being at substantially opposite sides of the card holder;

the ledge means extending around at least part part of the first and second faces, and having flange means extending across part of the first and second faces;

an attachment aperture being at an edge part of the card holder, the first and second faces each having projection means extending outwardly from the first and second faces respectively, the card holder being formed such that when it is in use a pair of substantially planar cards can be held by the card holder wherein one of the cards is adjacent the first face and the other of the cards is adjacent the second face such that each card is located between the flange means and the projection means respectively at a different side of the card holder respectively, and wherein inadvertent release of the cards from the card holder is substantially prevented by way of the ledge means.

DESCRIPTION OF THE DRAWINGS

Some preferred forms of the invention will now be described by way of example and with reference to the accompanying drawings, of which.

DETAILED DESCRIPTION

Figure 1:
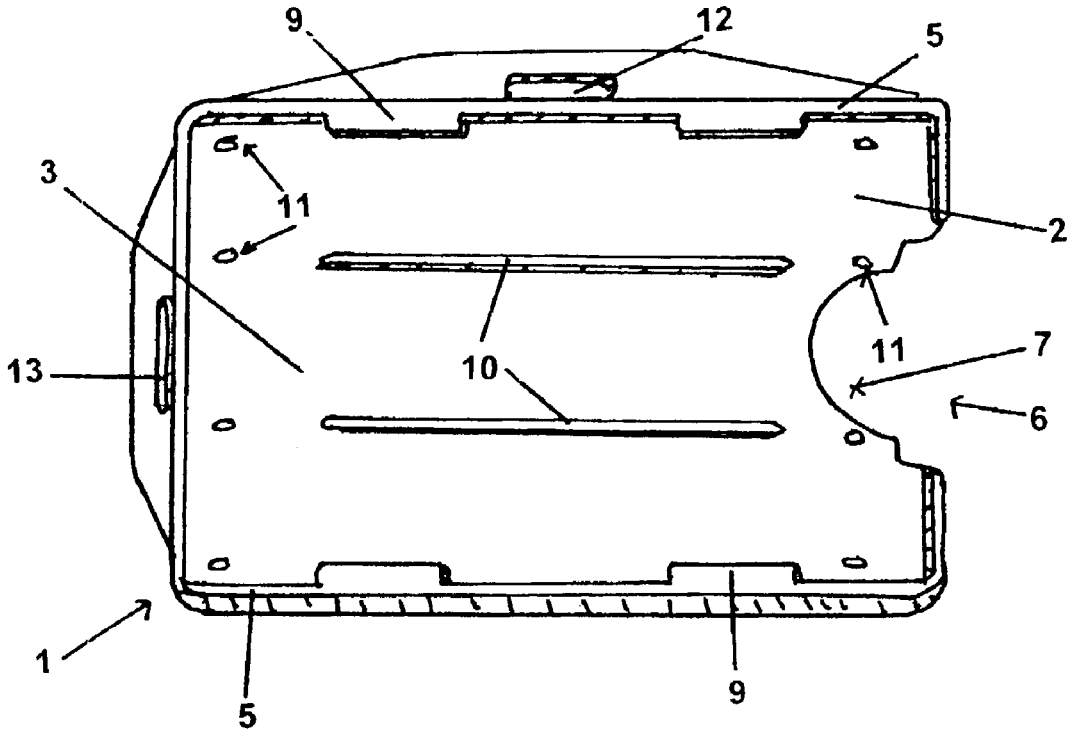
FIG. 1 is a perspective view of a security card holder formed in accordance with the invention.
Figure 2:
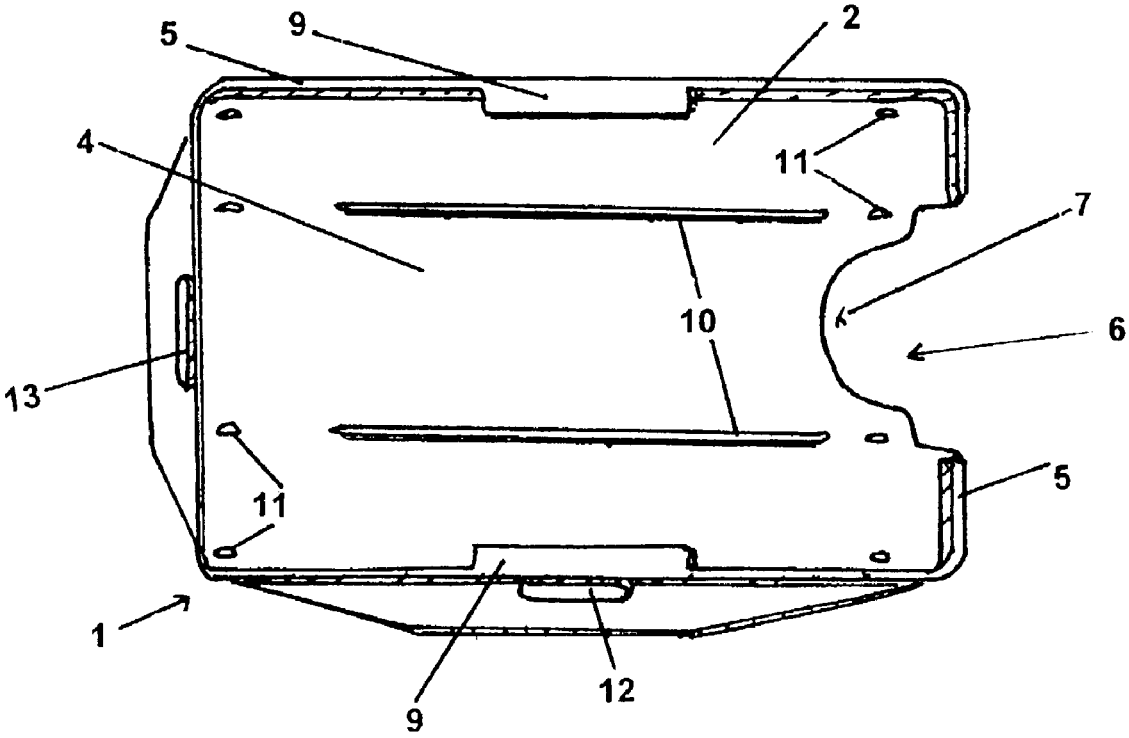
FIG. 2 is a reverse perspective view of the card holder.
Figure 3:
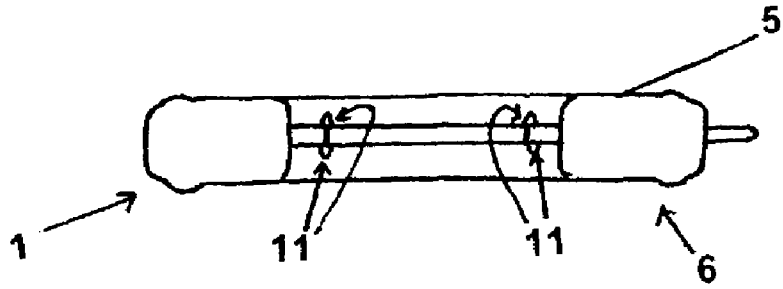
FIG. 3 is a front elevation view of the card holder.
Figure 4:
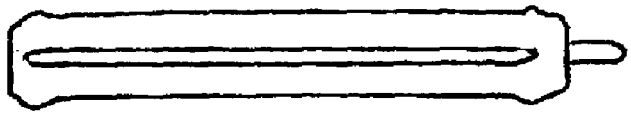
FIG. 4 is a rear elevation view of the card holder.
Figure 5:
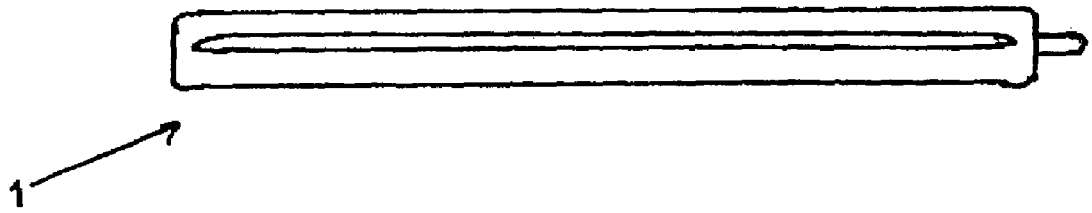
FIG. 5 is a side elevation view of the card holder.
Figure 6:
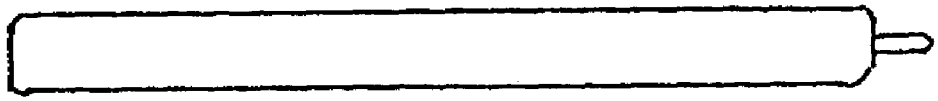
FIG. 6 is an opposite side elevation view of the card holder.

The security card holder 1 is preferably formed from a substantially flexible plastic material, although suitable alternative materials may be used The card holder 1 comprises a planar rectangular body 2 having a first face 3 and an opposite second face 4. As shown, a ledge 5 extends substantially around and outwards of the first and second faces 3 and 4. As shown in FIGS. 1 and 2, the ledge 5 extends fully around three edges of the first and second faces 3 and 4, but only partially along a short edge 6 of the rectangular shape.

The part of the short edge 6 which does not have the ledge 5 has a "cut-away" portion 7 to assist one to grasp and remove a security card 8 (see FIG. 7) after it has been inserted into the card holder 1. FIG. 8 shows the card 8 when fitted to the card holder 1.

In some embodiments of the invention the ledge may be in non-continuous spaced parts, but even in that embodiment it should nonetheless be considered to be a "ledge".

Referring to FIGS. 1 and 2, the ledge 5 of the card holder has a plurality of flanges 9 adapted to extend over the first and second faces respectively. As shown in FIG. 1, there are four of the flanges 9 overhanging the first face 3 and two of the flanges 9 overhanging the second face 4. As also shown in FIGS. 1 and 2, the first and second faces 3 and 4 each have a pair of longitudinal ridges 10, and a series of nodes 11, extending outwards from the faces respectively, but not to the same extend as the ledge 5. The ridges 10 are ramped at each end, and the nodes 11 are ramped at their inward ends. The nodes are ridge-like, but are of-course significantly shorter than the ridges 10.

Figure 7:
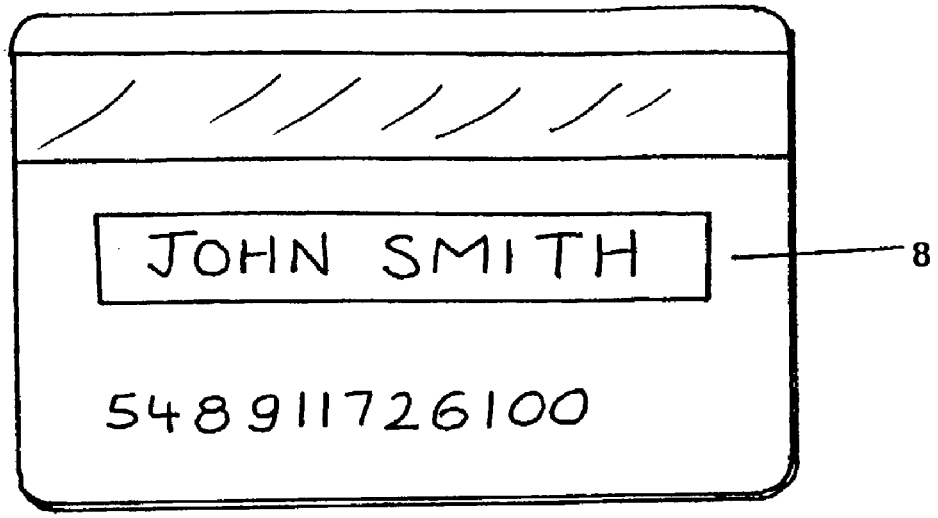
FIG. 7 is a perspective view of a security card suitable for use with the card holder of FIGS. 1-6.
Figure 8:
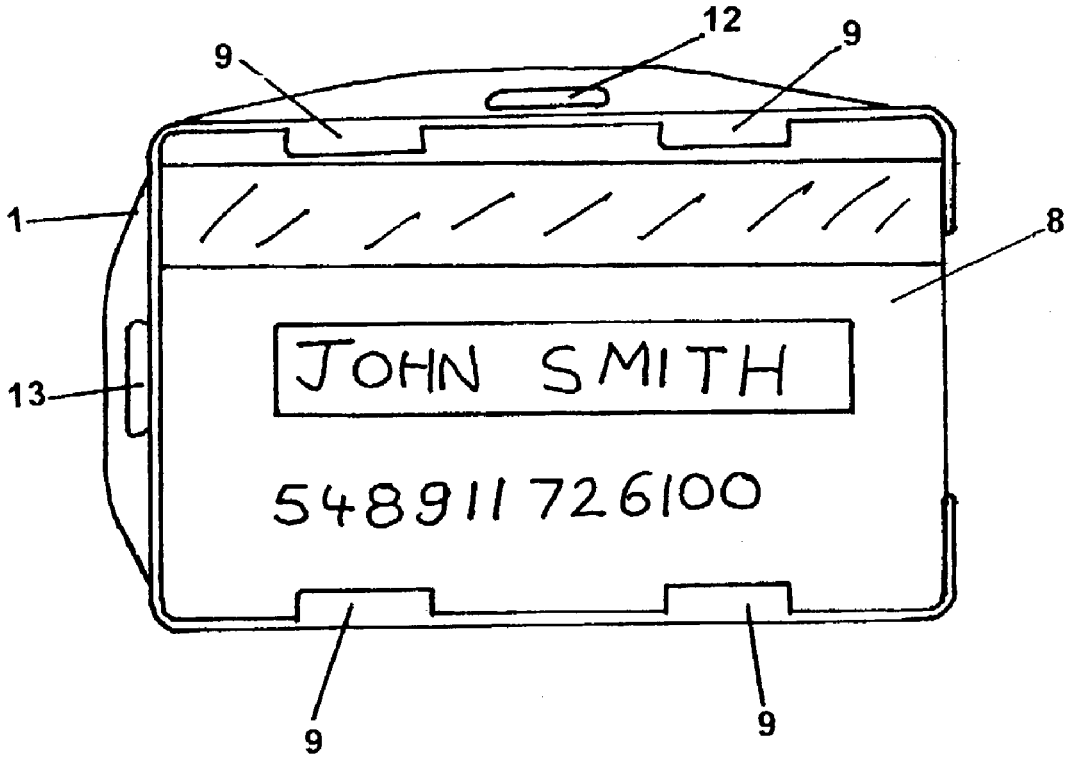
FIG. 8 is a plan view showing the security card of FIG. 6 when fitted to the card holder.

When the card holder 1 is in use a pair of cards as shown at FIG. 7 can be fitted thereto. This involves taking one of the cards and sliding it into the space between one of the faces 3 and 4 and its associated flanges 9. The other card is fitted in similar fashion by sliding it into the space between the other of the faces and its associated flanges 9. The cards are thus each fitted within the ledge 5 with each at an opposite face of the card holder. The card holder can thus accommodate two cards simultaneously. Fitting the cards may necessitate bending them, or the card holder, slightly so that the cards can slip over the ledge 5 at the short end 6 and then under the flanges 9 closest to that short end 6.

The ridges 10 and the nodes 11 serve to hold the cards slightly up off the respective faces 3 and 4 such that the cards are in a substantially close fit between the ridges/nodes on one hand, and the flanges 9 on the other. This serves to prevent or reduce the likelihood of the cards undesirably slipping free from the card holder.

Referring to FIGS. 1 and 2, the card holder has a first attachment aperture 12 and a second attachment aperture 13. The attachment apertures 12 and 13 are arranged on different edges of the card holder wherein such edges are perpendicular to one another. One of the attachment apertures 12 is thus at a long edge of the rectangular shape, and the other 13 is at a short edge of the rectangular shape which does not have the cutaway portion 7. As shown, each aperture 12 and 13 is of a generally longitudinal shape. The attachment apertures 12 and 13 can be used alternatively for receiving a retractable line which secures the card holder 1 to the clothing of a a person. Depending on which aperture 12 or 13 is used, the card holder and thus the associated cards can be worn in a vertical orientation or in a horizontal orientation. This proves useful as some identity cards need to be worn in one or the other of these orientations to correctly display the identity details that they carry.

In some embodiments of the invention the space between the flanges 9 and the ridges/nodes 10 and 11 may be different on one side of the holder to the other. This enables the card holder 1 to be used more effectively with two cards wherein each card has a different thickness.

While some preferred forms of the invention have been described by way of example, it should be appreciated that modifications and improvements can occur within departing from the scope of the following claims.

The invention claimed is:

1. A portable card holder, generally in the form of a plate, the card holder having a generally completely exposed first face and a generally completely exposed second face, ledge means extending outwardly from and around at least some peripheral parts of the first and second faces, part of the ledge means having flange means arranged such that the flange means cantilevers across a minor part of the first and second faces; the card holder being formed such that when it is in use a pair of substantially planar cards, each card approximately the shape and size of a standard credit card, can be snugly fitted to the card holder so that one of the cards is adjacent the first face and the other of the cards is adjacent the second face, the card holder formed so that the cards are able to be so fitted by passing each card over a respective part of the ledge means and under a respective part of the flange means so that the cards are blocked from inadvertent withdrawal from the card holder by the ledge means, and wherein when the cards are so fitted a main face of each card is generally completely exposed; the card holder having an exposed attachment aperture suitable for receiving means which attaches the card holder to the body of a person when the card holder is in use; the card holder having a vacant cutaway portion proceeding from an edge of the holder into the first and second faces of the holder and arranged such that edge parts of the cards, when fitted as described in this claim, are not bordered by the ledge means and do not have any of the card holder between them so as to facilitate ready grasping and removal of the cards from the holder when the holder is in use.

2. A portable card holder according to claim 1, formed so that it is generally rectangular, thus having two long side parts and two short side parts, the ledge means being absent from at least part of one of the short side parts adjacent the vacant portion.

3. A portable card holder according to claim 1, having projection means extending outwards from at least one of the first and second faces of the card holder, the projection means arranged such that it bears against at least one of the cards when fitted as set out in claim 1 to facilitate a close fit between that card and the card holder.

4. A portable card holder according to claim 1, having ramped projection means extending outwards from at least one of the first and second faces of the card holder, the projection means arranged such that it bears against at least one of the cards when fitted as set out in claim 1 to facilitate a close fit between that card and the card holder.

5. A portable card holder according to claim 1, having a second attachment aperture, one of the attachment apertures being at a first side part of the holder and the other attachment aperture being at a second side part of the holder wherein each of said side parts are generally perpendicular with respect to one another, one of the attachment apertures being arranged so that it is suitable for use when orienting the holder horizontally on the body of a person and the other so that it is suitable for use in orienting the card vertically on the body of the person.

6. A portable card holder according to claim 1, wherein the flange means comprises tab like flanges at one of the card holder faces and tab like flanges at the other card holder face.

7. A portable card holder according to claim 1, wherein the flange means comprises tab like flanges at one of the card holder faces and tab like flanges at the other card holder face, the tab like flanges at each of these faces being staggered, or in other words out of alignment, with those at the other of these faces.

8. A portable card holder, generally in the form of a plate, the card holder having a generally completely exposed first face and a generally completely exposed second face, ledge means extending outwardly from and around at least some peripheral parts of the first and second faces, part of the ledge means having flange means arranged such that the flange means cantilevers across a minor part of the first and second faces; a pair of substantially planar cards, each card approximately the shape and size of a standard credit card, snugly fitted to the card holder so that one of the cards is adjacent the first face and the other of the cards is adjacent the second face, the cards having been so fitted by passing each card over a respective part of the ledge means and under a respective part of the flange means so that the cards are blocked from inadvertent withdrawal from the card holder by the ledge means, and wherein a main face of each card is generally completely exposed; the card holder having an exposed attachment aperture suitable for receiving means which attaches the card holder to the body of a person when the card holder is in use; the card holder having a vacant portion proceeding from an edge of the holder into the first and second faces of the holder and arranged such that edge parts of the cards, when fitted as described in this claim, are not bordered by the ledge means and do not have any of the card holder between them so as to facilitate ready grasping and removal of the cards from the holder when the holder is in use.

9. A portable card holder according to claim 8, wherein the flange means comprises tab like flanges at one of the card holder faces and tab like flanges at the other card holder face.

10. A portable card holder according to claim 8 wherein the flange means comprises tab like flanges at one of the card holder faces and tab like flanges at the other card holder face, the tab like flanges at each of these faces being staggered, or in other words out of alignment, with those at the other of these faces.

11. A portable card holder according to claim 8, formed so that it is generally rectangular, thus having two long side parts and two short side parts, the ledge means being absent from at least part of one of the short side parts adjacent the vacant portion.

12. A portable card holder according to claim 8, having projection means extending outwards from at least one of the first and second faces of the card holder, the projection means arranged such that it bears against at least one of the cards to facilitate a close fit between that card and the card holder.

13. A portable card holder according to claim 8, having ramped projection means extending outwards from at least one of the first and second faces of the card holder, the projection means arranged such that it bears against at least one of the cards to facilitate a close fit between that card and the card holder.

14. A portable card holder according to claim 8, having a second attachment aperture, one of the attachment apertures being at a first side part of the holder and the other attachment aperture being at a second side part of the holder wherein each of said side parts are generally perpendicular with respect to one another, one of the attachment apertures being arranged so that it is suitable for use when orienting the holder horizontally on the body of a person and the other so that it is suitable for use in orienting the card vertically on the body of the person.

* * * * *